US010023278B1

(12) United States Patent
Smith et al.

(10) Patent No.: US 10,023,278 B1
(45) Date of Patent: Jul. 17, 2018

(54) PNEUMATIC FENDER SYSTEM FOR VESSELS

(71) Applicants: Gideon Smith, Ft. Lauderdale, FL (US); Jana Alaxova, Ft. Lauderdale, FL (US)

(72) Inventors: Gideon Smith, Ft. Lauderdale, FL (US); Jana Alaxova, Ft. Lauderdale, FL (US)

( * ) Notice: Subject to any disclaimer, the term of this patent is extended or adjusted under 35 U.S.C. 154(b) by 0 days.

(21) Appl. No.: 15/704,385

(22) Filed: Sep. 14, 2017

Related U.S. Application Data

(60) Provisional application No. 62/396,903, filed on Sep. 20, 2016.

(51) Int. Cl.
*B63B 59/02* (2006.01)
*B63B 43/02* (2006.01)

(52) U.S. Cl.
CPC ..... *B63B 59/02* (2013.01); *B63B 43/02* (2013.01); *B63B 2059/025* (2013.01)

(58) Field of Classification Search
CPC ..... B63B 43/02; B63B 43/10; B63B 43/04; B63B 43/12; B63B 43/14
USPC ..... 114/68, 360
See application file for complete search history.

(56) References Cited

U.S. PATENT DOCUMENTS

| | | | | |
|---|---|---|---|---|
| 3,026,839 A * | 3/1962 | Fridge | B63B 1/22 | 114/68 |
| 3,952,350 A * | 4/1976 | Moucka | B63C 9/22 | 114/68 |
| 4,817,555 A * | 4/1989 | Meinen | B63B 43/14 | 114/68 |
| 5,113,779 A * | 5/1992 | Amrein | B60F 3/0038 | 114/68 |
| 6,830,004 B2 * | 12/2004 | Mears | B63B 43/14 | 114/360 |
| 2006/0016380 A1 * | 1/2006 | Braitberg | B63B 43/12 | 114/360 |

* cited by examiner

*Primary Examiner* — Lars A Olson
(74) *Attorney, Agent, or Firm* — Sanchelima & Associates, P.A.; Christian Sanchelima; Jesus Sanchelima

(57) ABSTRACT

A boat hull protection system to prevent structural and cosmetic damage to vessels and prevent them from sinking. The system includes inflatable members inflated using pneumatics such as compressed air that can be selectively inflated by a user along the stern, starboard or port sides, or bow of a given vessel. The inflatable members are inflated using a plurality of inflatable compartments housed within the inflatable members thereby allowing the system to continue being effective in light of a failure to a portion of the inflatable member.

18 Claims, 15 Drawing Sheets

PNEUMATIC FENDER SYSTEM FOR VESSELS

RELATED APPLICATIONS

The present invention claims priority and benefit of U.S. provisional application 62/396,903 filed on Sep. 20, 2016 and is herein incorporated by reference.

BACKGROUND OF THE INVENTION

Field of the Invention

The present invention relates to a vessel damage prevention and, more particularly, to a system having a plurality of inflatable members to prevent damage to vessels and sinking.

Description of the Related Art

Several designs for systems to prevent damage to boats have been designed in the past. None of them, however, include a plurality of inflatable members housing individual compartments that are inflated using pneumatics, specifically, the pneumatic means can be compressed air from a compressor or high air pressure cylinder.

Applicant believes that a related reference corresponds to E.P. Patent EP0568501 issued to Giuseppe Floris for an inflatable hull protecting device for boats. However, it differs from the present invention because the present invention includes a plurality of compartments within the inflatable members so that the system continues to work even if there is a failure of one of the compartments. The Floris reference fails to solve this problem since that system would fail as a whole with a puncture along any portion of the inflatable members. The present system solves this unaddressed problem since the compartments are independent of each other. One compartment can fail without compromising the functionality of the system as a whole.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a system to prevent structural and cosmetic damage to vessels by nearby vessels or objects.

It is one of the main objects of the present invention to provide a system that can prevent the sinking of vessels by providing the necessary buoyancy to maintain them afloat.

It is another object of this invention to provide a system that can continue to operate even if there is a puncture or damage to specific areas of the inflatable members.

It is still another object of the present invention to provide a system that can be selectively inflated based on the needs of a user.

It is another object of this invention to provide a system that does not consume much electricity and is quickly and reliably inflated using pneumatics.

It is yet another object of this invention to provide such a system that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
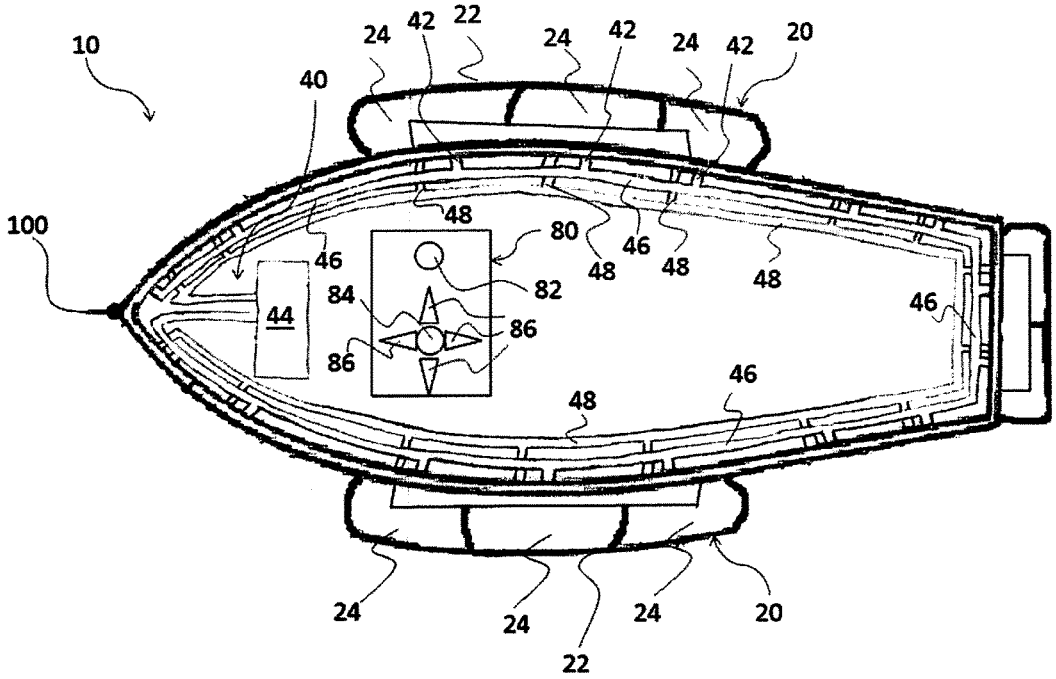
FIG. 1 represents a top plan view of the present invention showing the inflatable members in their expanded configuration.
Figure 2A:
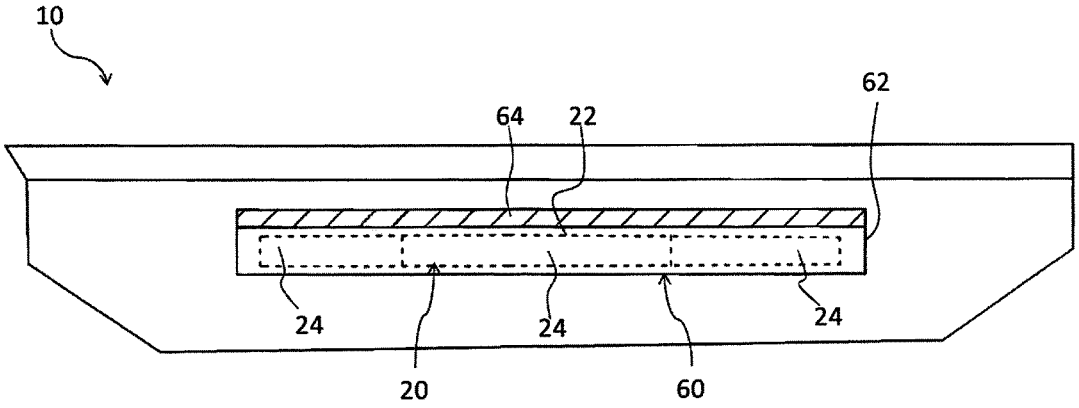
FIG. 2A is a representation of a side elevational view of the present system showing a cross-section of the splash rail with the inflatable members therein.
Figure 2B:
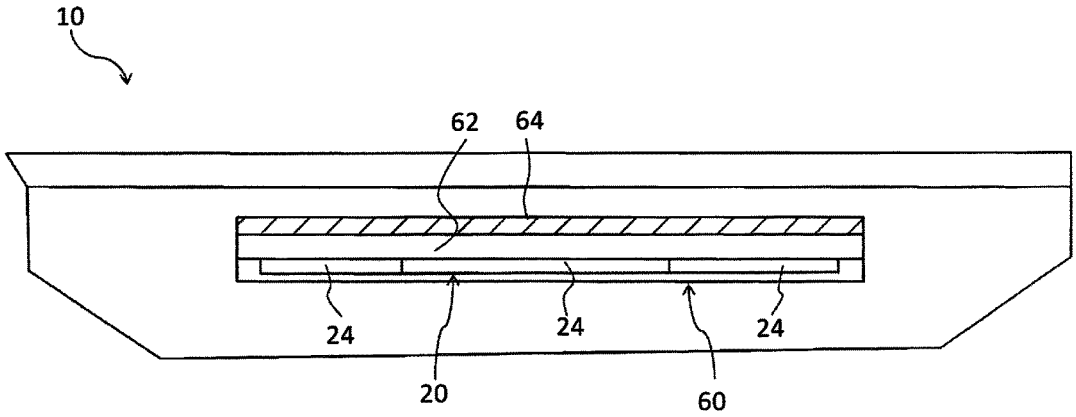
FIG. 2B shows a side elevational view of the present invention showing the inflatable members housed within the splash rail of a vessel.
Figure 2C:
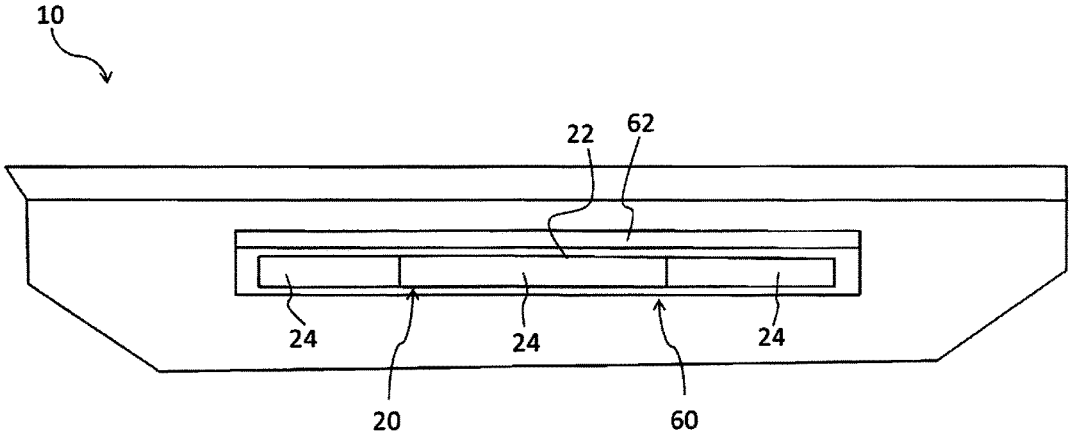
FIG. 2C demonstrates a side elevational view of the present invention showing the splash rail retracted partially exposing the inflatable members.
Figure 2D:
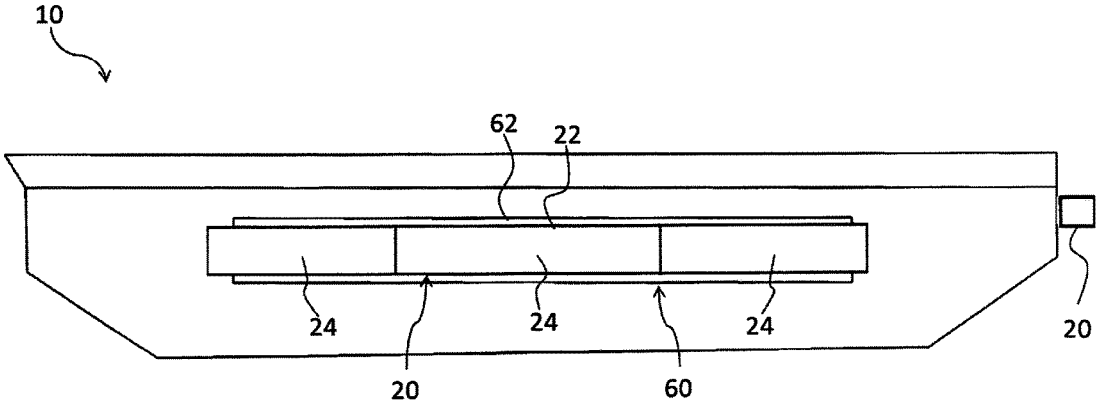
FIG. 2D illustrates a side elevational view of the present invention wherein the splash rail has been fully retracted and the inflatable members are in the inflated position. The inflatable members can be housed inside the splash rail, or the splash rail can hingedly lift revealing the inflatable members. Also, the splash rail can be made of the two sections that lift away from each other revealing the inflatable member.
Figure 2E:
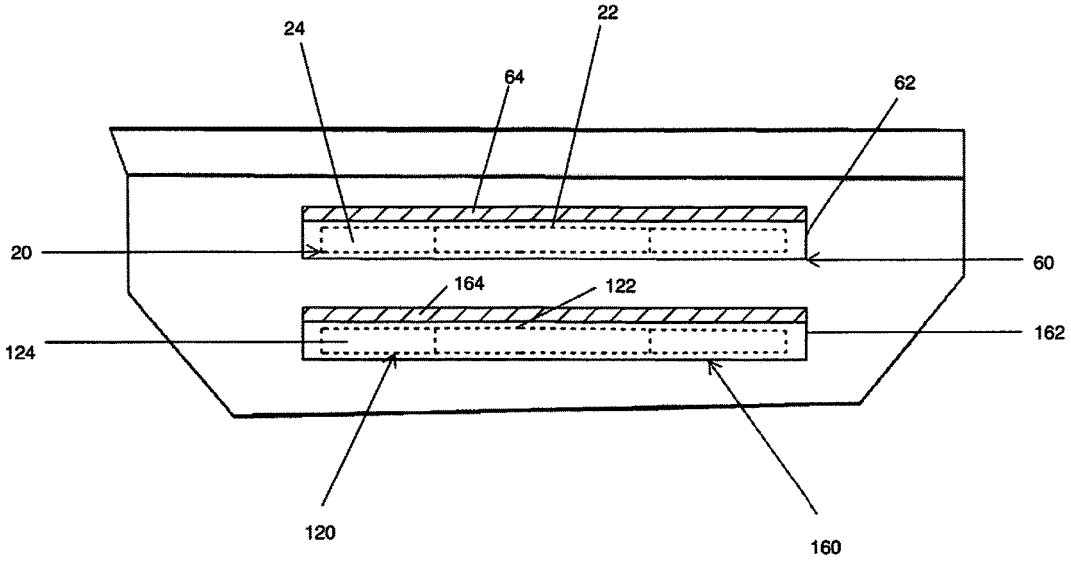
FIG. 2E is a representation of a side elevational view of the present system showing a cross-section of two splash rails with the inflatable members therein.
Figure 2F:
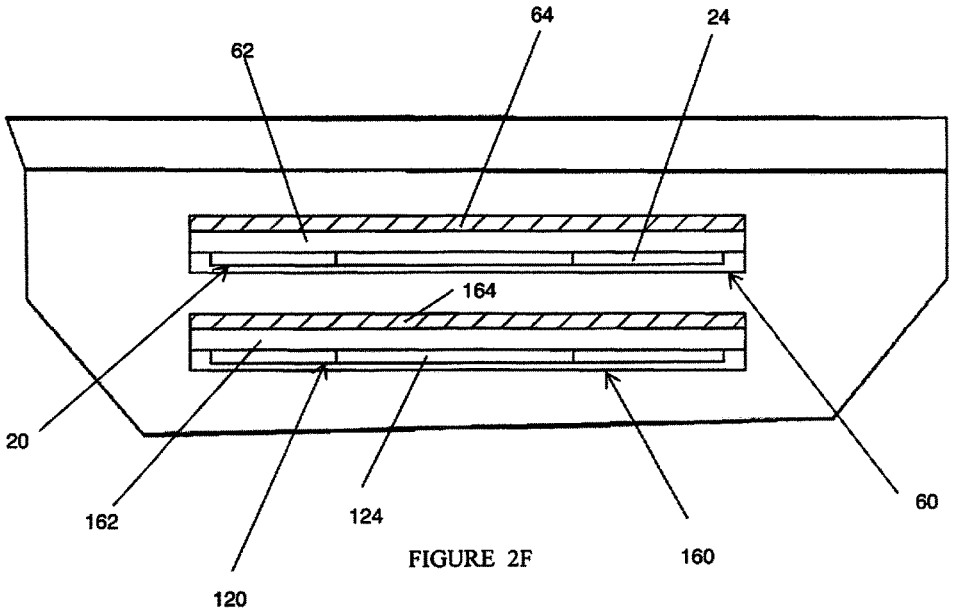
FIG. 2F shows a side elevational view of the present invention showing the inflatable members housed within both splash rails of a vessel.
Figure 2G:
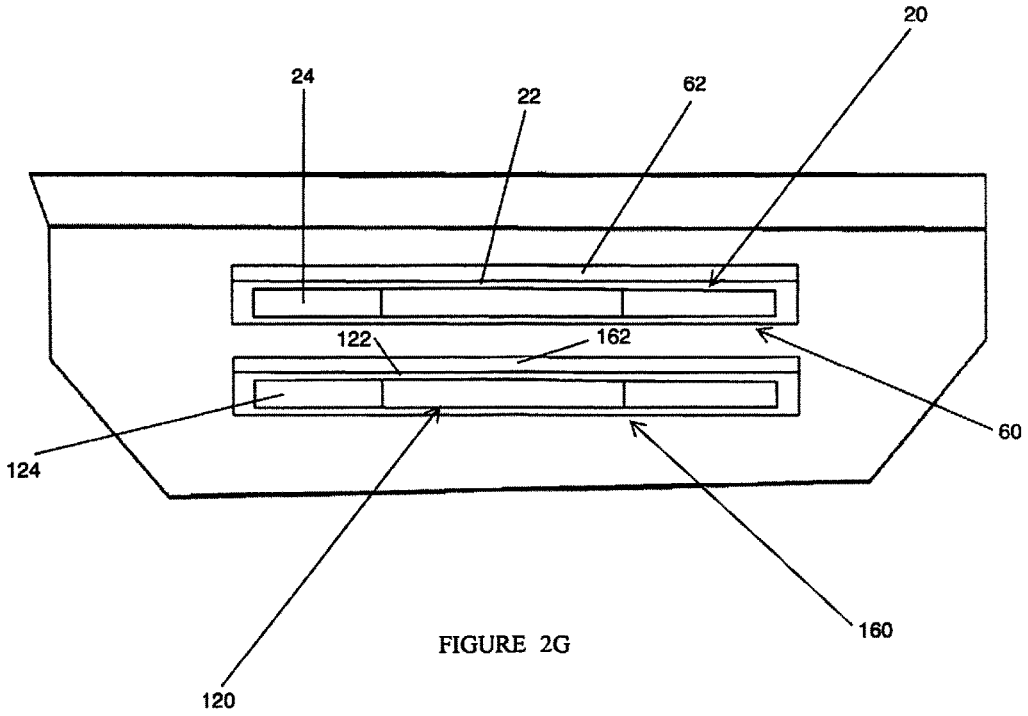
FIG. 2G demonstrates a side elevational view of the present invention showing two splash rail retracted partially exposing the inflatable members.
Figure 2H:
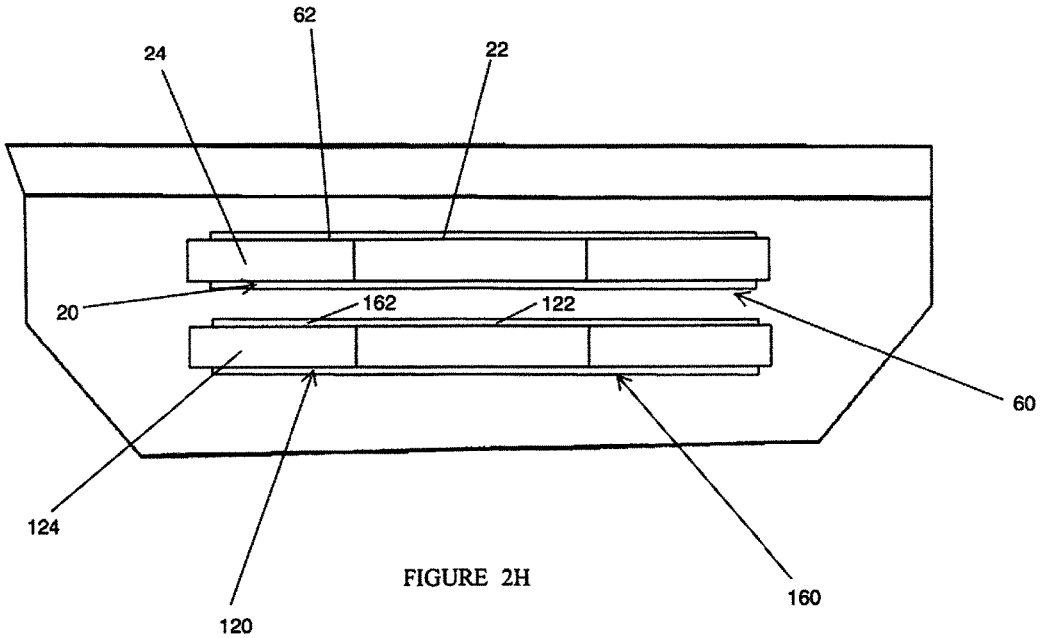
FIG. 2H illustrates a side elevational view of the present invention wherein both splash rails have been fully retracted and the inflatable members are in the inflated position.
Figure 3:
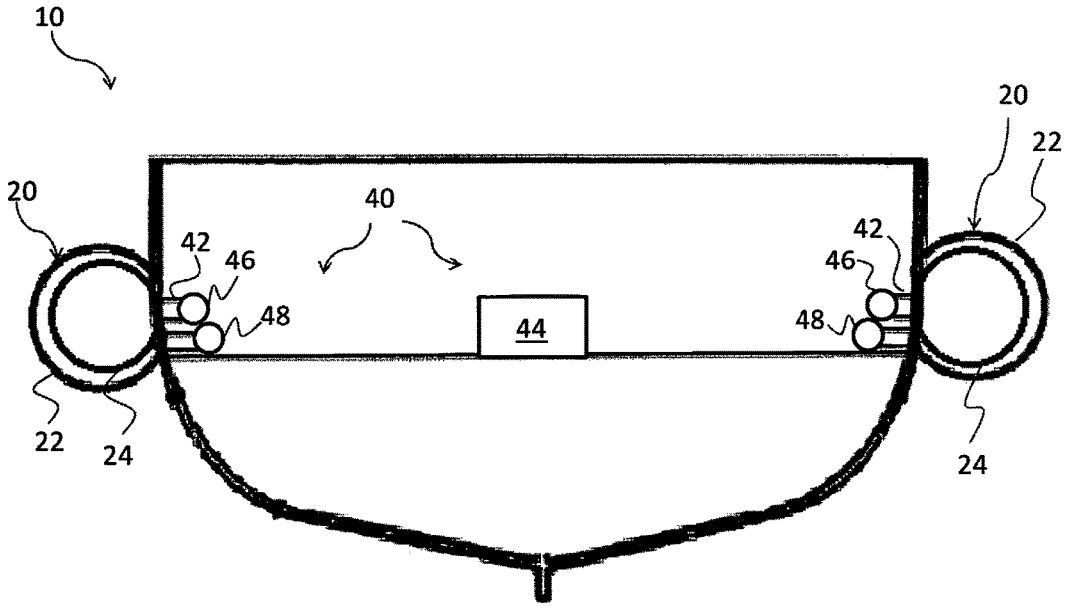
FIG. 3 is an illustration of a cross-section of the inflatable members showing the individual inflatable compartments within the inflatable members.
Figure 3A:
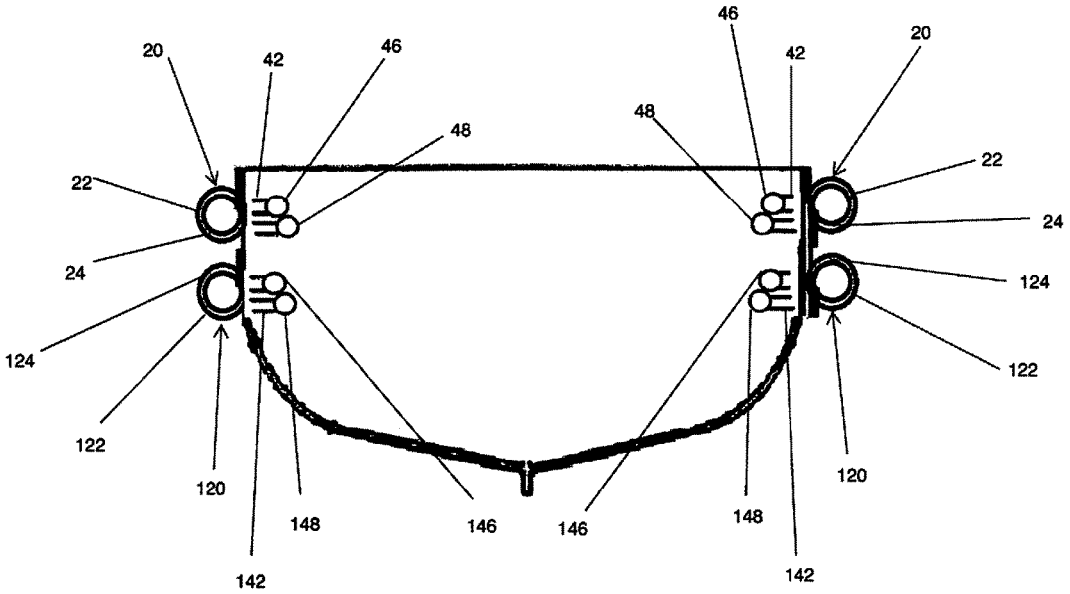
FIG. 3A is an illustration of a cross-section of the inflatable members showing the individual inflatable compartments within the inflatable members.
Figure 4:
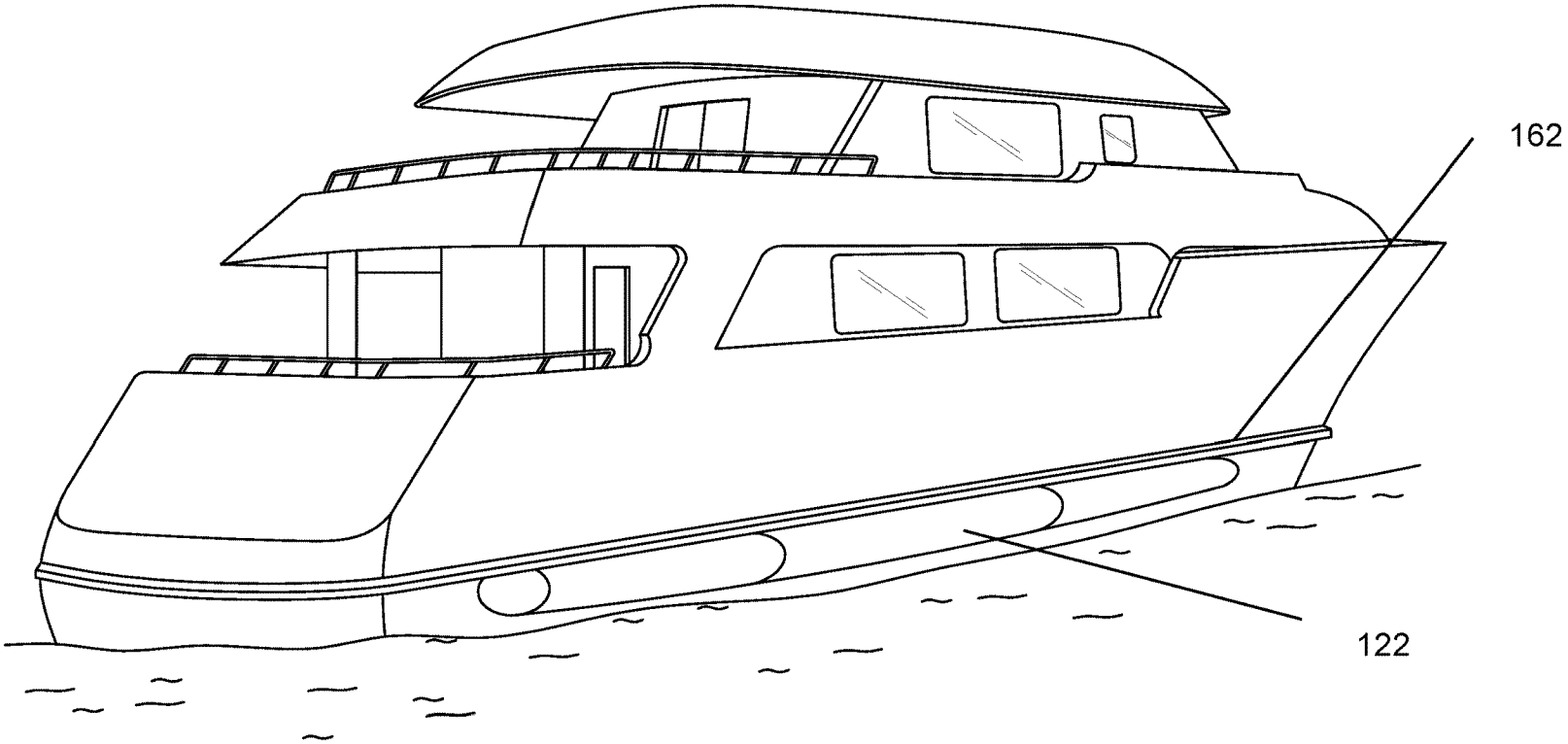
FIG. 4 shows an isometric view of a vessel showing the inflatable members deployed from the bottom of the splash rail.
Figure 5A:
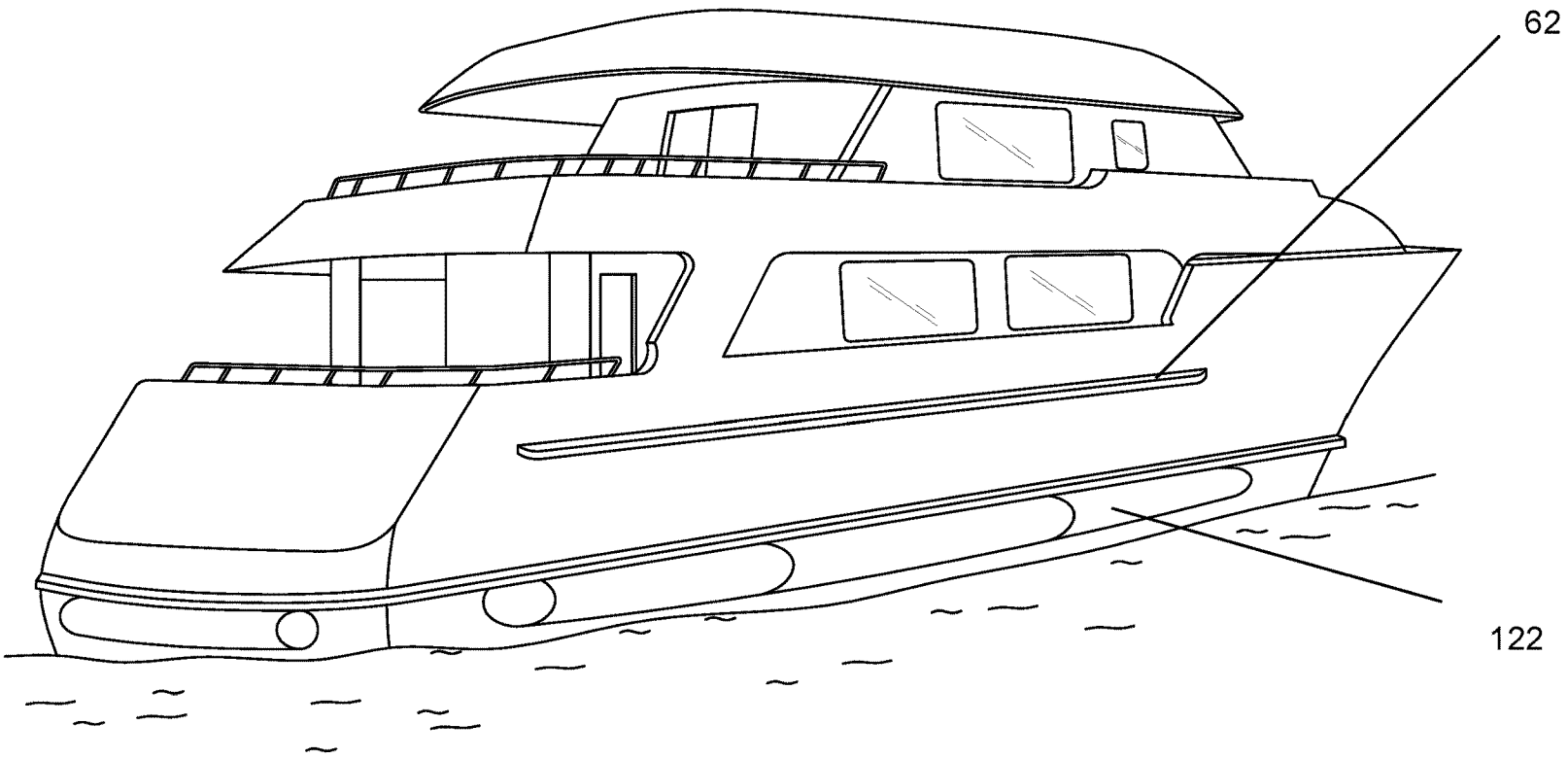
FIG. 5A shows the same as FIG. 4 with the addition of an additional inflatable member deployed from a splash rail at the aft of the vessel.
Figure 5B:
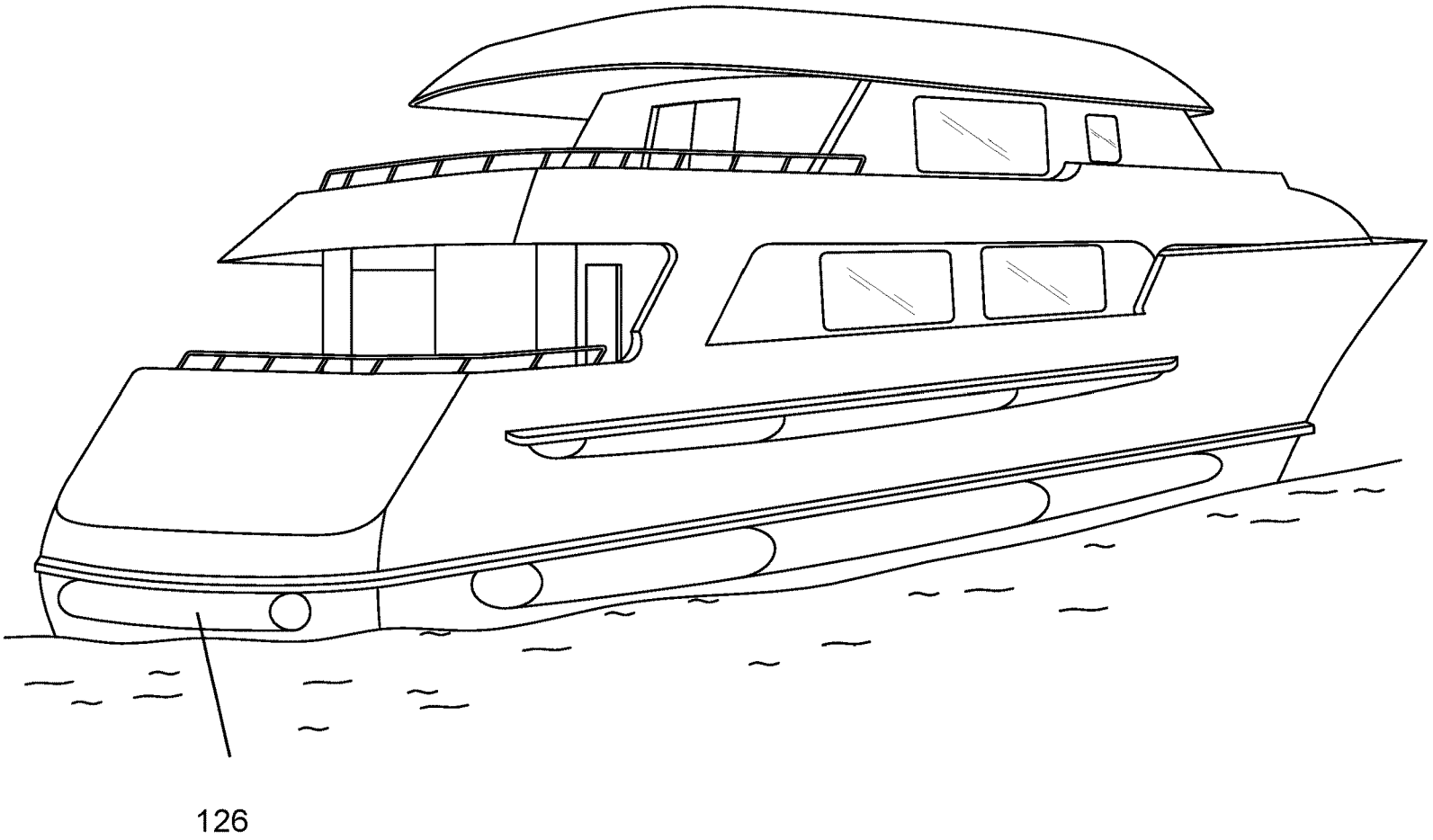
FIG. 5B shows a vessel with two splash rails along the said of the hull with the present invention implemented in both.
Figure 5C:
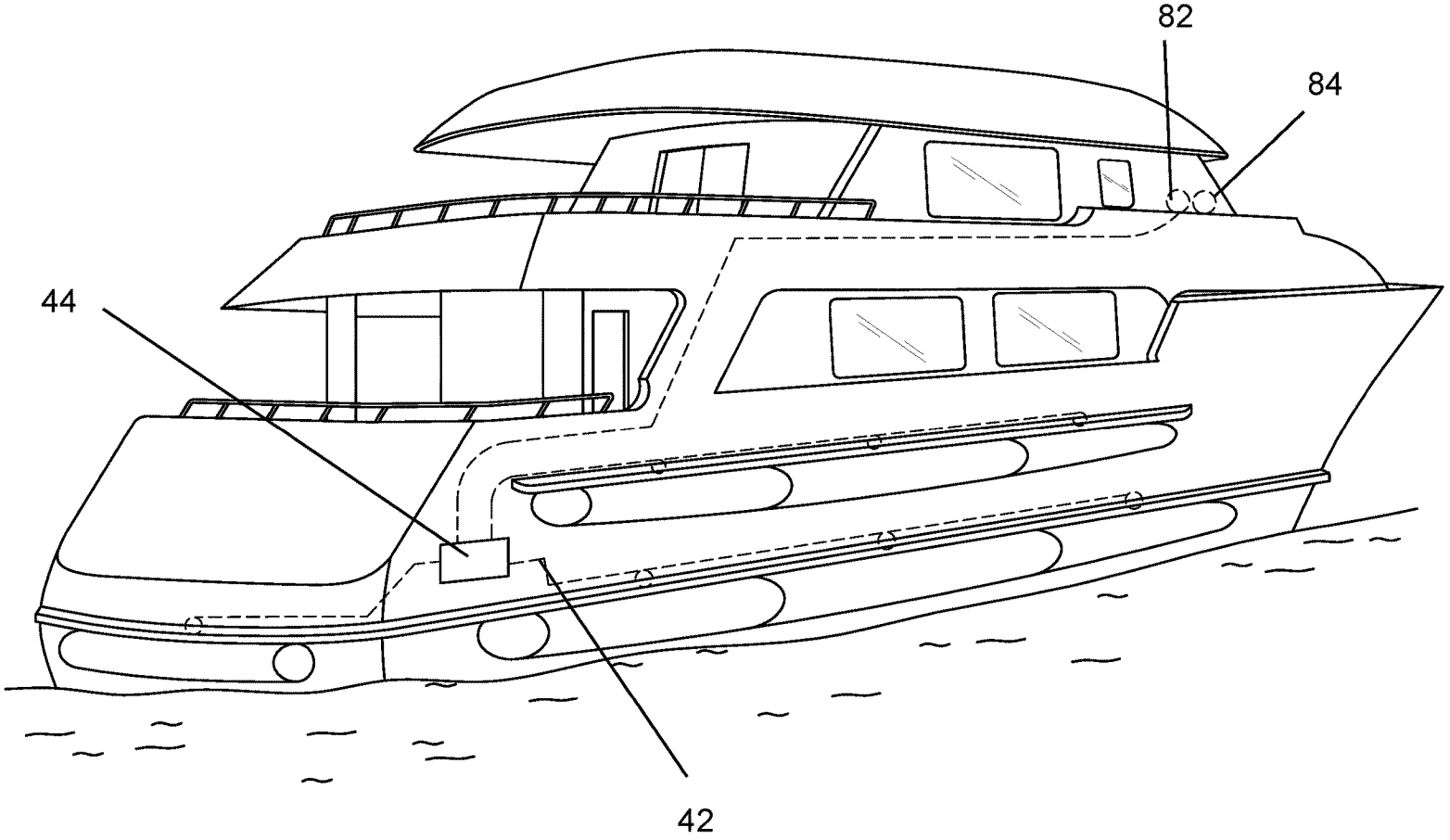
FIG. 5C represents a partial see-through view showing the air hoses connected to the various inflatable members.

Referring now to the drawings, where the present invention is generally referred to with numeral 10, it can be observed that it basically includes inflatable fender assembly 20, air supply assembly 40, splashrail assembly 60, and control unit assembly 80.

Inflatable fender assembly 20 includes inflatable members 22 and inflatable compartments 24. Inflatable members 22 are installed to cooperate with splashrail assembly 60 and can be implemented along the aft, stern, port and starboard of a given vessel to prevent damage to the vessel when it comes into close proximity to other vessels or obstacles on the water. Also, inflatable members 22 can be configured with sufficient buoyancy to maintain a vessel afloat for a predetermined amount of time until assistance can be reached or passengers and crews can be safely disembarked.

Inflatable compartments 24 are housed within the entirety of inflatable members 22 and can each independently connected to the air supply so that if one compartment fails the rest of inflatable fender assembly can remain useful. Optionally, inflatable members 22 can be selectively inflated so that a user can select to inflate the fenders on only one or more sides of the vessel, such as the port side. Also, in another related embodiment, inflatable members 22 can include a single inflatable compartment 24 or inflatable members 22 can include no compartments and just be inflated or expanded itself.

Air supply assembly 40 can connect inflatable fender assembly 20 to the source of pressurized air to inflate inflatable compartments 24. Air supply assembly 40 includes a plurality of supply hoses 42 and air source 44. Air source 44 can be at least one compressor or at least one cylinder having high pressured air. In one embodiment, air supply assembly 40 can include a main hose 46 that extends along the circumference of the vessel and supplied air from air source 44 to plurality of supply hoses 42. Supply hoses 42 can also act to suction air from inflatable compartments 24 or, optionally, a separate set of suction hoses 48 can be installed to suction the air out of inflatable compartments 24.

Splashrail assembly 60 includes spashrail 62 and hinged means 64 that can be manually, or in a preferred embodiment, automatically actuated to open and close splashrail 62. In its starting position, splashrail 62 is closed and completely covers inflatable fender assembly 20 to maintain an aesthetic look to the vessel. Upon activation, splashrail 62 opens revealing inflatable fender assembly 20 and allowing inflatable members 22 to expand away from the vessel's hull when inflatable compartments 24 are being inflated. In an alternate embodiment, spashrail 62 can be divided in two or more portions that are spring-loaded and are opened to allow the inflatable members to expand outwards once inflated. The splashrail can be defined by an upper and lower portion that open from the middle of the splashrail where both upper and lower portions meet in the closed position.

When a user no longer needs inflatable members 22 inflated then the air inside inflatable compartments 24 is suctioned back into air supply assembly 40 and they are cooperatively nestled within splashrail assembly 60 so that splashrail 62 can again close to hide inflatable fender assembly 20. Hinged means 64 can be actuated using an independent motor for each or all of the hinged means 64 can be powered by one designated motor.

Control unit assembly 80 sends the instructions to the motor for hinged means 64 to open and close upon a user pressing a splashrail actuation button 82 on the control unit assembly 80. The vessel can also include a plurality of sensors 100 along the outer circumference of the hull that allow splashrail 62 to lift and allow inflatable members 22 to automatically deploy upon objects being closer than a predetermined distance to the vessel. Control unit assembly 80 further includes air supply activation button 84 that allows a user to inflate and deflate inflatable members 22. Control unit assembly 80 also includes directional buttons 86 that allow a user to select which side of the vessel will have the inflatable members 22 deployed. In an alternate embodiment of the present invention, the upper and lower fenders are offset and lower fender is extended further back with respect to the upper fender. In the alternate embodiment shown in FIGS. 2E-2H and 3A, the present invention can be configured to be used with two splash rails having the same system in each. In this embodiment, second inflatable fender assembly 120 includes inflatable members 122 that are housed within inflatable compartments 124. As shown in FIG. 1, aft inflatable members 126 can be included on the aft of the vessel. Second inflatable fender assembly 120 is configured with air supply assembly 140 that includes supply hose 142, air supply 144, main hose 146, and suction hose 148. Second splash rail assembly 160 can be seen having splash rail 162. In one embodiment, control unit assembly 80 can be located in the pilot house. In another embodiment, the sponson of the vessel can be extended and also incorporate inflatable member therein. In an operating environment, the amount of air supplied to the inflatable members can be calculated based on the weight of the vessel to ensure that the inflatable members can keep the vessel afloat.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A vessel protection device, comprising:

a splashrail housing mounted to a hull, at least one fender housed within said splashrail housing, a pneumatic system, said splashrail housing adapted to being opened and deploying said at least one fender using said pneumatic system, said hull includes an exterior, a plurality of sensors are located along the exterior of the hull or said splashrail housing adapted to communicate with a control unit to notify said at least one fender to deploy.

2. The vessel protection device of claim 1 further including a compressor and air supply hoses, said at least one fender being inflatable, said compressor inflating said at least one fender using said air supply hoses, a suction member to suction back the air using said air supply hoses, thereby allowing said at least one fender to retract into said splashrail housing.

3. The vessel protection device of claim 1 wherein said hull includes a bow, a stern, a port side, and starboard side, said splashrail housing located at said bow, stern, port side or starboard side.

4. The vessel protection device of claim 1 wherein said hull includes a port and starboard side, said splashrail housing located at said port and starboard side, said at least one fender can be deployed at said port and starboard side independently.

5. The vessel protection device of claim 1 wherein said splashrail housing is hingedly mounted to said hull.

6. The vessel protection device of claim 1 including a control unit, said splashrail housing including a motor, said control unit coordinating said splashrail housing's opening and closing using said motor.

7. A vessel protection device, comprising:

a splashrail housing mounted to a vessel's hull, said at least one splashrail housing including an upper and lower portion hingedly mounted to said vessel's hull, at least one inflatable fender housed within said splashrail housing, a compressor, a plurality of air hoses, said at least one inflatable fender adapted to being inflated by said compressor using said plurality of air hoses, a control unit that actuates the compressor and controls the inflating and deflating of said at least inflatable fender, said hull includes an exterior, a plurality of sensors are located along the exterior of the hull or said splashrail housing adapted to communicate with said control unit to notify said at least one fender to deploy.

8. The upper and lower portion of claim 7 wherein a motor controls their opening and closing, said upper and lower portions opened away from each other allowing said at least inflatable fender to deploy in between them.

9. The vessel protection device of claim 7 wherein said at least one splashrail housing includes an upper and lower splashrail housing, said hull including a port side, a starboard side, said at least one splashrail housing adapted to being mounted to said port and starboard sides.

10. The vessel protection device of claim 7 wherein said at least one inflatable member is partitioned to include at least one inflatable compartment so that the inflatable member is still effective even if part of it is damaged.

11. A vessel protection device, comprising:

a splashrail member positioned along a hull, at least one compartment housed within said hull, said at least one compartment entirely housing at least one inflatable fender and covered by said splashrail member, a compressor, a plurality of air hoses, a control unit connected to a motor, said splashrail hingedly mounted to said hull and raised or lowered through said control unit using said motor to allow said at least inflatable fender to deploy out of said at least one compartment and when deployed remain adjacent to said splashrail, said hull includes an exterior, a plurality of sensors are located along the exterior of the hull or said splashrail housing adapted to communicate with said control unit to notify said at least one fender to deploy.

12. The vessel protection device of claim 11 wherein said splashrail includes an upper and lower portion that are opened in opposite directions using said motor to reveal said at least one inflatable fender and allow said at least one inflatable member to deploy.

13. The vessel protection device of claim 11 wherein said hull includes a starboard side, a port side, a stern, and a bow, said at least one compartment and said splashrail are located at said starboard side, said port side, said stern, and said bow.

14. The vessel protection device of claim 11 wherein said hull includes a starboard side, a port side, a stern, and a bow, said at least one compartment and said splashrail are located at said starboard side, said port side, said stern, or said bow.

15. The vessel protection device of claim 11 wherein said port or starboard side includes an upper and lower splashrail, said at least one compartment includes a first and second compartment both located within the periphery of the hull and behind said upper and lower splashrail, respectively.

16. The vessel protection device of claim 11 wherein said port and starboard side includes an upper and lower splashrail, said at least one compartment includes a first and second compartment both located within the periphery of the hull and behind said upper and lower splashrail, respectively.

17. The vessel protection device of claim 11, wherein said port and starboard side includes an upper and lower splashrail, said at least one compartment includes a first and second compartment both located within the periphery of the hull and behind said upper and lower splashrail, respectively.

18. The vessel protection device of claim 11 wherein said at least one inflatable member is partitioned to include at least one inflatable compartment so that the inflatable member is still effective even if part of it is damaged.

* * * * *